United States Patent [19]

Carr et al.

[11] 4,230,556

[45] Oct. 28, 1980

[54] INTEGRATED COAL LIQUEFACTION-GASIFICATION PROCESS

[75] Inventors: Norman L. Carr, Allison Park, Pa.; Bruce K. Schmid, Denver, Colo.

[73] Assignee: Gulf Oil Corporation, Pittsburgh, Pa.

[21] Appl. No.: 970,005

[22] Filed: Dec. 15, 1978

[51] Int. Cl.[2] ..... C10G 1/00; C10G 1/08; C10J 3/00

[52] U.S. Cl. ..... 208/8 LE; 208/10; 48/210

[58] Field of Search ..... 208/8 LE, 10; 48/210

[56] References Cited

U.S. PATENT DOCUMENTS

| | | | |
|---|---|---|---|
| 3,540,995 | 11/1970 | Wolk et al. | 208/10 |
| 3,884,796 | 5/1975 | Hinderliter et al. | 208/8 |
| 3,962,070 | 6/1976 | Stotler | 208/10 |
| 4,090,943 | 5/1978 | Moll et al. | 208/8 |
| 4,102,775 | 7/1978 | Quarderer et al. | 208/8 |

OTHER PUBLICATIONS

Solvent Refined Coal (SRC) Process Mo. report 2/78, Pitt. & Midway Coal Mining Co., U.S. Dept. of Energy, Pub. Mar. 1978.

Solvent Refined Coal (SRC) Process Mo. report 3/78, Pitt. & Midway Coal Mining Co., Pub. Apr. 1978, U.S. Dept. of Energy.

SRC Quarterly Report No. 1, Runs 62–70, 1/76–3/76, SRC Pilot Plant Electric Power Research Institute, Pub. 6/76.

vol. 2, Coal Processing Tech. Pub. by Am. Institute of Engineers, The H-Coal Pilot Plant Program, H. H. Stotler, 1975.

*Primary Examiner*—Delbert E. Gantz

*Assistant Examiner*—William G. Wright

[57] ABSTRACT

In a coal liquefaction process the yield of liquid coal is increased with a concomitant decrease in the yield of normally solid dissolved coal by recycle of a product slurry containing mineral residue. In an integrated coal liquefaction-gasification process employing product slurry recycle wherein the net yield of normally solid dissolved coal from the liquefaction zone comprises the entire hydrocarbonaceous feed to the gasification zone, a moderate net yield of normally solid dissolved coal is conducive to an optimized efficiency for the integrated process. However, it is frequently difficult to perform the process at slurry recycle rates which are sufficiently low to be economically practicable because of a pumpability constraint on the solids level in the feed coal mixing vessel. In the present process, mechanical operability is improved and enhanced conversion of normally solid dissolved coal is achieved by passing a portion of the liquefaction zone product slurry through a hydroclone with the hydroclone overflow stream constituting a second recycle slurry. Deployment of the second recycle slurry accomplishes selective recycle of relatively small particles of mineral residue and tends to reduce the yield of normally solid dissolved coal without resorting to excessive recycle rates, contributing to optimized efficiency for the integrated process.

9 Claims, 2 Drawing Figures

INTEGRATED COAL LIQUEFACTION-GASIFICATION PROCESS

The present invention relates to an improved process for the solvent liquefaction of coals such as bituminous or subbmituminous coals or lignites.

While the most desirable products from a coal solvent liquefaction process are coal liquids and hydrocarbon gases, such processes normally tend to also produce high yields of normally solid dissolved coal. Normally solid dissolved coal is economically less valuable than liquid coal and hydrocarbon gases because of its solid state and its generally higher content of sulfur and other impurities. In addition, because normally solid dissolved coal is recovered from the liquefaction zone in slurry with suspended mineral residue it must be processed in a solids-liquid separation step, such as filtration or settling. Since the suspended mineral residue particles are very small, the solids-liquid separation step is difficult to perform and has a considerable adverse effect upon the economics of the liquefaction operation.

A coal solvent liquefaction process can advantageously avoid a solids-liquid separation step by vacuum distilling the liquefaction zone product to prepare a liquefaction zone product slurry comprising normally solid dissolved coal and mineral residue and passing this slurry to a gasifier for conversion of its hydrocarbonaceous content to hydrogen and to syngas fuel for use in the process. The product slurry comprises all the normally solid dissolved coal produced in the liquefaction zone and is advantageously substantially free of liquid coal and hydrocarbon gases because liquid coal and hydrocarbon gases produced in the liquefaction zone constitute high quality fuels without further processing. This slurry can comprise substantially the entire hydrocarbonaceous feed for a gasification zone integrated with the liquefaction zone and essentially no other hydrocarbonaceous feed is required by the gasification zone.

It has been found that the thermal efficiency of an integrated coal liquefaction-gasification process is relatively low when the yield of normally solid dissolved coal is high, but that the thermal efficiency can be increased to a relatively high level when the yield of normally solid dissolved coal is decreased to a level such that upon gasification it is adequate to product only sufficient hydrogen and syngas fuel to satisfy process requirements. The optimization of thermal efficiency in an integrated coal liquefaction-gasification process is described in Ser. No. 905,298, filed May 12, 1978, in the name of Bruce K. Schmid, now U.S. Pat. No. 4,159,237, which is hereby incorporated by reference.

The yield of normally solid dissolved coal can be advantageously moderated in an integrated coal liquefaction-gasification process by recycling all of the slurry containing normally solid dissolved coal and mineral residue which is not passed to the gasification zone. Slurry recycle imparts several advantageous effects in a coal solvent liquefaction process. First, recycle of the normally solid dissolved coal in the product slurry affords this material an opportunity for conversion to more valuable liquid fuel and to hydrocarbon gases. Secondly, the mineral residue contained in the slurry constitutes a catalyst for reactions beginning in the preheater zone and continuing in the dissolver (reactor) zone which favor the production of liquid coal.

Finally, since all normally solid dissolved coal obtained from the liquefaction zone is either recycled or gasified, there is no net yield of normally solid dissolved coal from the process, whereby a difficult solids-liquid separation step is obviated and process efficiency is increased. For all of these reasons, a combination coal liquefaction-gasification process employing slurry recycle to moderate the amount of normally solid dissolved coal available as a gasifier feed performs at a much higher thermal efficiency than a combination coal liquefaction-gasification process devoid of a slurry recycle stream.

The achievement of a high thermal efficiency in an integrated liquefaction-gasification operation requires that the entire yield of normally solid dissolved coal produced in the liquefaction zone be passed to the gasification zone and that this normally solid dissolved coal constitutes substantilly the entire hydrocarbonaceous feed for the gasification zone. Integration of the liquefaction and gasification zones to achieve a high thermal efficiency requires that the yield of normally solid dissolved coal, from which substantially all liquid coal and hydrocarbon gases have been removed, be just sufficient to enable the gasification zone to produce all process hydrogen, and an amount of syngas adequate to supply between 5 and 100 percent of process fuel requirements. If any other product of the liquefaction zone is included in the gasifier feed, such as liquid coal or hydrocarbon gases, or if the liquefaction zone produces an amount of normally solid dissolved coal greater than that required by the gasification zone for the production of process hydrogen and syngas fuel, the thermal efficiency of the combination liquefaction-gasification process will be diminished.

An integrated coal liquefaction-gasification process requires recycle of a process slurry stream in order to reduce the net yield of normally solid dissolved coal to a level which is sufficiently low to provide a high efficiency for the integrated process. As stated above, the recycle stream tends to reduce the yield of normally solid dissolved coal by increasing the level of catalytic solids within the process and by increasing the total residence time of normally solid dissolved coal. For feed coals which generate high yields of mineral residue, the concentration of solids in the recycle slurry and therefore in the feed coal mix tank become so high that feed tank effluent pumpability problems arise. A high solids level in the feed coal mix tank is ordinarily overcome by increasing the recycle slurry rate at a given coal feed rate because of the diluting effect of an increasing slurry recycle rate. However, for high ash coals, i.e. coals containing more than 15 or 20 weight percent of inorganic mineral matter on a dry basis, the recycle rate must be increased to such a high level to adequately reduce the solids level in the coal mixing vessel that an excessive economic penalty develops in terms of slurry pumping costs and preheater size. For a given plant size, such a situation can necessitate a severe reduction in the raw coal feed rate.

The present invention tends to avoid this difficulty by reducing the amount of solids that are recycled while still maintaining adequate cataytic activity. In addition, for a given solids recyle rate the catalytic activity can be enhanced. These effects are achieved by segregating the solids in the product slurry so that the gasifier feed slurry and the recycle slurry each has a nonaliquot proportion of the total solids, with the solids in the recycle slurry having a relatively smaller median size and being more catalytically active as compared to the solids in the gasifier feed slurry. According to the present invention, the recycle slurry contains less than an aliquot weight proportion of solids and the gasifier feed slurry contains more than an aliquot weight proportion of solids, as compared to the total liquefaction zone product slurry.

Normally liquid coal is the primary product of the present process. Normally liquid coal is referred to herein by the terms "distillate liquid" and "liquid coal", both terms indicating dissolved coal which is normally liquid at room temperature, including what is sometimes referred to as process hydrogen donor solvent. A concentrated slurry containing only 850° F.+(454° C.+) material is obtained from theliquefaction zone. The concentrated slurry contains all of the inorganic mineral matter and all of the undissolved organic material (UOM) of the feed coal, which together is referred to herein as "mineral residue". The amount of UOM will always be less than 10 or 15 weight percent of the feed coal. The concentrated slurry also contains the 850° F.+(454° C.+) dissolved coal, which is normally solid at room temperature, and which is referred to herein as "normally solid dissolved coal."

Synthesis gas produced in the gasification zone is subjected to the shift reaction to convert it to hydrogen and carbon dioxide. The carbon dioxide, together with hydrogen sulfide, is then removed in an acid gas removal system. Essentially all of the gaseous hydrogen-rich stream so produced is utilized in the liquefaction process. It is advantageous to produce more synthesis gas than is required to supply process hydrogen. To obtain a high thermal efficiency in an integrated coal liquefaction-gasification process, at least 60, 70 or 90 and up to 100 mol percent of this excess portion of the synthesis gas should be burned as fuel within the process. The excess synthesis gas should not be subjected to a methanation step or to any other hydrogen-consuming reactions, such as conversion to methanol, prior to combustion within the process. When the gasification operation is entirely integrated into the liquefaction operation so that substantially the entire hydrocarbonaceous feed for the gasification zone is derived from the liquefaction zone and substantially the entire gaseous product from the gasification zone is consumed within the liquefaction zone, either as hydrogen reactant or as syngas fuel, the integrated process achieves an unexpectedly high thermal efficiency.

FIG. II discloses a flow diagram of the claimed invention.

Figure 1:
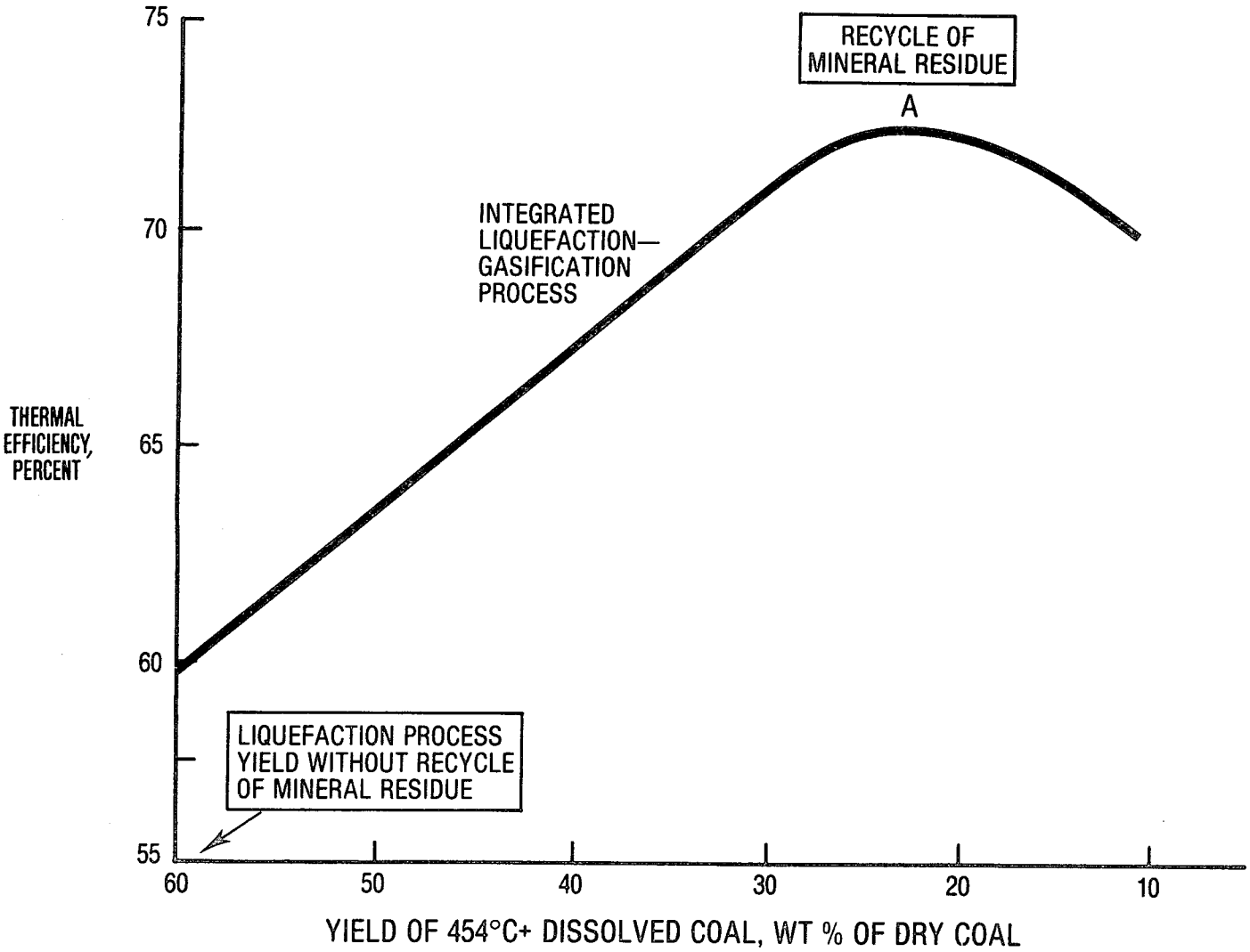
FIG. 1 discloses a graph of the thermal efficiency verses the yield of 454° C. plus dissolved coal, wt.% of dry coal. The graph also discloses the effect of mineral residue.

The elevated thermal efficiency achievable in an integrated coal liquefaction-gasification process is illustrated in FIG. 1. FIG. 1 relates the thermal efficiency of an integrated coal liquefaction-gasification process to the yield of normally solid dissolved coal, i.e. 850° F.+(454° C.+) dissolved coal, which is solid at room temperature. The integrated process illustrated in FIG. 1 does not employ the solids segregation method of this invention, but rather illustrates the need therefore. In the process of FIG. 1, product slurry is recycled in the liquefaction zone and the net 850° F.+(454° C.+) slurry yield from the liquefaction zone is passed to the gasification zone and comprises the only carbonaceous feed to the gasification zone. When the quantity of 850° F.+(454° C.+) dissolved coal prepared and passed to the gasification zone changes, the composition and amount of the recycle slurry in the liquefaction zone automatically changes. Point A on the curve represents the general region of maximum thermal efficiency of the combination process.

FIG. 1 shows that the thermal efficiency of the integrated process is very low at 850° F.+(454° C.+) dissolved coal yields higher than 35 or 40 percent. FIG. 1 indicates that in the absence of recycle mineral residue, the yield of 850° F.+(454° C.+) dissolved coal is in the region of 60 percent, based on feed coal. FIG. 1 indicates that with recycle of mineral residue the yield of 850° F.+(454° C.+) dissolved coal is moderated to the region of 20 to 25 percent, which corresponds to the region of maximum thermal efficiency for the integrated process. The thermal efficiency curve in FIG. 1 is discussed in detail in aforementioned application Ser. No. 905,298 now U.S. Pat. No. 4,159,237.

It is frequently difficult to reduce the yield of normally solid dissolved coal in an integrated liquefaction-gasification process to a sufficiently low level to enable process efficiency to be optimized to the region A. One method of overcoming this difficulty is to increase the solids content of the slurry recycle stream by decreasing the quantity of normally liquid coal contained therein. In practice, however, use of this method is limited by the solids constraint level in the feed coal mixing vessel. In an integrated liquefaction-gasification process employing the method of this invention, the yield of 850° F.+(454° C.+) normally solid dissolved coal is moderated to a level capable of achieving optimum thermal efficiency A in part through the utilization of a second recycle stream. The second recycle stream comprises a hydroclone overflow stream as described below.

The liquefaction zone of the present process includes preheater and dissolver zones in series. The liquefaction zone can be operated independently or it can be integrated with a gasification zone, as described above. The temperature of the reactants gradually increases during passage through a preheater coil so that the preheater outlet temperature is generally in the range 680° to 820° F. (360° to 438° C.), and preferably is in the range 700° to 760° F. (371° to 404° C.). Generally, most of the coal dissolution occurs within the preheater zone and exothermic hydrogenation and hydrocracking reactions involving dissolved hydrocarbons begin to occur at the maximum preheater zone temperature. The preheated slurry is then passed to a dissolver or reactor zone wherein the hydrogenation and hydrocracking reactions continue. The dissolver zone is normally well backmixed and is at a relatively uniform temperature. The heat generated by the exothermic reactions in the dissolver zone raises the temperature within the dissolver zone to the range 800° to 900° F. (427° to 482° C.), preferably 840° to 870° F. (339° to 466° C.). The residence time of the slurry in the dissolver zone is longer than in the preheater zone. Because of the exothermic reactions occurring therein, the dissolver temperature may be at least 20°, 50°, 100° or even 200° F. (11°, 27.5°, 55.5° or even 111° C.) higher than the temperature at the outlet of the preheater.

The dissolver zone does not contain any fixed catalyst bed, neither stationary nor ebullated, so that it does not have any actual or psuedo catalyst level at an intermediate position in the reactor. The only catalyst is the minerals suspended in the process slurry which enter and leave the dissolver in suspension in the process slurry. Of course, it is possible to have a slight amount of slippage of solids within the reactor, but essentially all particles are eventually removed from the reactor.

The hydrogen pressure in the preheating and dissolver zones is in the range 1,000 to 4,000 psi, and is preferably 1,500 to 2,500 psi (70 to 280, and is preferably 105 to 174 kg/cm$^2$). The hydrogen is generally added to the slurry at more than one point. At least a portion of the hydrogen is added to the slurry prior to the inlet of the preheater zone. Additional hydrogen may be added between the preheater and dissolver zones and/or as quench hydrogen in the dissolver zone itself. Quench hydrogen is injected at various points when needed in the dissolver zone to maintain the reaction temperature at a desired level which avoids significant coking reactions. The ratio of total hydrogen to raw coal feed is in the range 20,000 to 80,000, and preferably 30,000 to 60,000 SCF per ton (0.62 to 2.48 and preferably 0.93 to 1.86 M$^3$/kg).

In the inventive embodiment involving a gasification zone, the maximum gasifier temperatures are in the range 2,200° to 3,600° F. (1,204° to 1,982° C.), generally; 2,300° to 3,200° F. (1,260° to 1,760° C.), preferably; and 2,400° or 2,500° to 3,200° F. (1,316° or 1,371° to 1,760° C.), most preferably. At these temperatures, the inorganic mineral matter is converted to molten slag which is removed from the bottom of the gasifier.

The liquefaction process produces for sale a significant quantity of both liquid coal and hydrocarbon gases. When the liquefaction process is operated without a gasification zone it may also produce for sale some normally solid dissolved coal. However, in the absence of a gasification zone it is preferable to recycle the normally solid dissolved coal to extinction, thereby increasing the yield of liquid coal and hydrocarbon gases. In a liquefaction process operating without an integrated gasification zone and having a net yield of normally solid dissolved coal, a portion of the process slurry can be filtered to prepare a solids-free normally solid dissolved coal. The solids-free normally solid dissolved coal can be recycled to extinction or recovered as product.

When the liquefaction operation is integrated with a gasification operation, overall process thermal efficiency is enhanced by employing process conditions adapted to produce significant quantities of both hydrocarbon gases and liquid fuels, as compared to process conditions adapted to force the production of either hydrocarbon gases or liquids, exclusively. In an integrated liquefaction-gasification operation, the liquefaction zone should product at least 8 or 10 weight percent of $C_1$ to $C_4$ gaseous fuels, and at least 15 to 20 weight percent of 380° to 850° F. (193° to 454° C.) distillate liquid fuel, based on dry feed coal. A mixture of methane and ethane is recovered and sold as pipeline gas. A mixture of propane and butane is recovered and sold as LPG. Both of these products are premium fuels. Fuel oil boiling in the range 380° to 850° F. (193° to 454° C.) recovered from the process is a premium boiler fuel which is essentially free of mineral matter and contains less than about 0.4 or 0.5 weight percent of sulfur. Hydrogen sulfide is recovered from the process effluent in an acid gas removal system and is converted to elemental sulfur.

The effluent slurry from the dissolver zone passes through vapor-liquid separator means to remove a vapor comprising hydrogen, hydrocarbon gases, naphtha and possibly some distillate liquid from a residue slurry containing solvent boiling range liquid coal, normally solid dissolved coal and suspended mineral residue. Essentially all the hydrogen and essentially all the hydrocarbons boiling at a temperature below the boiling range of solvent liquid, including hydrocarbon gases and naphtha, are removed overhead in the vapor-liquid separator means. A small amount of solvent boiling range liquid will be removed in the overhead stream while a small amount of naptha will remain in the separator residue slurry.

The flash residue slurry can be apportioned in three ways as follows. The first portion of the flash residue slurry comprises between about 10 and 75 weight percent of the total residue slurry and is directly recycled to the feed mixing vessel, by-passing the hydroclone of this invention. The sensible heat in the flash residue slurry will heat the feed coal in the mixing vessel and tend to dry the coal if it is in a wet condition. The second portion of the flash residue slurry comprises between about 15 and 40 weight percent of the total residue slurry and is passed directly to a product separation system including atmospheric and vacuum distillation means for the removal of distillate coal liquids boiling in the range 380° to 850° F. (193° to 454° C.) from a concentrated slurry comprising 850° F.+ (454° C.+) normally solid dissolved coal together with suspended mineral residue. The third portion of the flash residue slurry comprises between about 10 and 75 weight percent of the total residue slurry and is passed through the hydroclone of this invention.

The flash residue slurry, of which the first, second and third portions are aliquot segments, contains between about 5 and 40 weight percent solids. The effluent from the hydroclone includes overflow and underflow streams. The hydroclone overflow stream contains less than an aliquot portion on a weight basis of the hydroclone solids while the hydroclone underflow stream contains more than an aliquot portion on a weight basis of the hydroclone solids. The solids-lean hydroclone overflow stream generally comprises between about 40 and 80 weight percent of the feed stream to the hydroclone and contains between about 0.2 and 20 weight percent solids. The median particle diameter of the solids in the hydroclone overflow stream is smaller than the particle diameter of the solids in the underflow stream and is generally between about 0.5 and 5 microns (overall particle diameter range is about 0.1 to 10 microns). The hydroclone overflow stream is recycled to the feed coal mixing vessel either independently of or in blend with the first portion of the flash residue slurry. The hydroclone underflow stream generally comprises between about 20 and 60 weight percent of the feed stream to the hydroclone and contains between about 10 and 50 weight percent solids. The underflow stream is passed to the product separation system either independently of or in blend with the second portion of the flash residue slurry.

The hydroclone is provided with a tangential inlet port for imparting a swirling motion to the stream flowing therethrough. Essentially no normally vaporous hydrocarbons and little or no naptha is passed to the hydroclone. The hydroclone does not separate or concentrate hydrocarbon components supplied to it. Therefore, except for solids content the overflow and underflow streams are similar and have about the same composition and boiling range, each containing about the same concentrations of liquid coal and normally solid dissolved coal as is contained in the flash residue slurry.

The 380° to 850° F. (193° to 454° C.) liquid coal content of the recycled first portion of residue slurry and of the recycled hydroclone overflow stream contains hydrogen donor hydrocarbons and constitutes the solvent of the liquefaction process. The 850° F.+(454° C.+) normally solid dissolved coal contained in these recycle streams may also contribute some solvent function. Generally, the first portion of residue slurry and the hydroclone overflow stream will contain all the solvent required by the process so that an independent solvent recycle stream will not be required. However, an independent solvent recycle stream can be employed, if desired. Substantially all the liquid boiling below the solvent boiling range should be taken overhead in the vapor-liquid separators to prevent recycle and concomitant overcracking thereof. Recycle of hydrocarbons boiling below the solvent boiling range would induce poor hydrogen economy, poor selectivity and inefficient utilization of reactor space.

The aforementioned first portion of the residue slurry will be referred to herein as the first recycle stream while the hydroclone overflow stream will be referred to herein as the second recycle stream since it supplements the first or principal recycle stream. The first and second recycle streams are both at an elevated temperature and will tend to contribute heat to the feed coal in the mix vessel and to remove any moisture remaining in the feed coal. While the first (hydroclone by-pass) recycle stream will generally contain between about 5 and 40 weight percent of solids, and can typically contain about 20 weight percent of solids, the second (hydroclone overflow) recycle stream will generally contain between about 0.2 and 20 weight percent of solids, and will typically contain only about 0.5 to 1 weight percent of solids. The median diameter of particles in the first recycle stream will be between about 1 and 10 microns (overall particle diameter range is about 0.1 to 40 microns), while the median diameter of particles in the second recycle stream is smaller and will be between about 0.5 and 5 microns. The weight ratio of the second to the first recycle stream can be between about 0.1 and 3, and can be intermittently or continuously adjusted to control the proportion of the relatively small solid particles in the total of recycled solid particles. In general, the first recycle stream will be recycled at a rate corresponding to 0.2 to 4 parts by weight of slurry per part by weight of raw coal feed and the second recycle stream will be recycled at a rate corresponding to 0.2 to 4 parts by weight of slurry per part by weight of raw feed coal.

The iron sulfides (pyrite, pyrrhotite) are believed to be the main catalytic entity contained in the recycle mineral residue. Recycle of this material improves conversion of normally solid dissolved coal to liquid coal and gaseous hydrocarbons. The recycle of mineral residue to limited because it imparts a viscosity increase limiting the pumpability of the feed slurry. The present invention achieves a high yield of liquid coal without excessive recycle of mineral residue by recycling the hydroclone overflow stream in addition to the first or conventional recycle slurry. The median size of the particles in the hydroclone overflow stream is smaller and these particles are therefore catalytically more active than the solids in the first recycle stream. The following examples show that the hydroclone overflow stream functions in a highly independent manner with respect to the first or primary recycle stream.

EXAMPLE 1

Tests presented below show the injection of pyrite and mill scale to a coal liquefaction process which does not employ slurry recycle. In these tests, a coal solvent liquefaction process performed without slurry recycle was operated both with no additive and with relatively large amounts of pulverized pyrite ($FeS_2$) obtained from water washing of raw coal, and with a relatively large amount of pulverized mill scale ($Fe_3O_4$). Mill scale is formed on the surface or iron during hot rolling. Iron oxides tend to become sulfided within the process by reaction with hydrogen sulfide. The conditions and results of these tests are presented in Table 1.

TABLE 1*

| Process Conditions | |
|---|---|
| Coal | Pittsburgh Seam, Washed |
| Pressure | 1900 psig (135 kg/cm$^2$) |
| Temperature | 450° C. (842° F.) |
| Solvent/Coal, weight ratio | 1.56 |
| Nominal Slurry Residence Time | 26.6 Minutes |
| Hydrogen/Feed Rate | 33,900 SCF/Ton of Coal (1.05 M$^3$/kg) |

Yield Data

| Additive | None | Pyrite | Pyrite | Mill Scale ($Fe_3O_4$) |
|---|---|---|---|---|
| Total Additive, wt. % of MF coal | 0.0 | 3.0 | 7.5 | 4.25 |
| Total Iron (Fe) in feed slurry (includes Fe in feed coal and additive), wt. % of MF coal | 0.9 | 2.1 | 3.9 | 3.9 |
| Yields, wt % MF Coal Basis | | | | |
| $C_1$–$C_4$ | 4.9 | 4.8 | 5.0 | 4.5 |
| Total Oil ($C_5$–850° F.) (454° C.) | 17.7 | 17.8 | 18.4 | 13.6 |
| Normally solid dissolved Coal (850° F.+ (454° C.+) | 62.0 | 62.9 | 62.4 | 65.5 |
| Insoluble Organic Matter | 6.4 | 6.3 | 6.7 | 7.8 |

*Data published in SOLVENT REFINED COAL (SRC) PROCESS, Monthly Report for the Period February, 1978. The Pittsburgh & Midway Coal Mining Co., published March 1978, United States Department of Energy. Contract No. EX-76-C-01-496. FE/496-147 UC-90d. Page 14.

The data of Table 1 show that in a coal solvent liquefaction process performed without slurry recycle the injection of relatively large amounts of pulverized pyrite or mill scale did not improve process yields. Injection of pyrite had no significant effect, while injection of mill scale resulted in a reduction of the yield of liquid oil and hydrocarbon gas with a concomitant increase in the yield of normally solid dissolved coal.

EXAMPLE 2

Tests were performed showing the effect of adding pulverized pyrite obtained from water washing of raw coal to a coal liquefaction process which employs slurry recycle. The conditions and results of these tests are shown in Table 2.

TABLE 2*

| Feed Coal | Pittsburgh Seam (Washed) | | |
|---|---|---|---|
| Nominal Residence Time, hr. | 0.99 | 0.99 | 1.01 |
| Coal Feed rate, lb/hr/ft$^3$ (kg/hr/m$^3$) | 21.2 (339.2) | 21.5 (344) | 21.3 (340.8) |
| Slurry Formulation (in feed mix | | | |

TABLE 2*-continued

| Feed Coal | Pittsburgh Seam (Washed) | | |
|---|---|---|---|
| vessel), wt. % | | | |
| Coal | 29.3 | 29.7 | 30.0 |
| Recycle Slurry (with solvent) | 68.5 | 69.4 | 70.0 |
| Additive (Pyrite) | 2.2 | 0.9 | 0.0 |
| Slurry Blend Composition (in feed mix vessel), wt. % | | | |
| Coal | 29.3 | 29.7 | 30.0 |
| Solvent liquid (193–454° C.) | 23.8 | 20.9 | 21.5 |
| Solid dissolved coal (454° C. +) | 26.4 | 32.7 | 34.3 |
| Ash (from recycle slurry) | 12.4 | 9.6 | 7.4 |
| Insoluble Organic Matter (from recycle slurry) | 5.9 | 6.2 | 6.8 |
| Additive (Pyrite)** | 2.2 | 0.9 | 0.0 |
| Hydrogen Feed Rate | | | |
| Wt. % based on slurry | 4.61 | 4.62 | 4.71 |
| MSCF/ton of coal | 59.3 | 58.6 | 59.1 |
| Nominal Dissolver Temperature, °C. | 455 | 455 | 455 |
| Pressure, psig (kg/cm$^2$) | 2250 (157.5) | 2250 (157.5) | 2250 (157.5) |
| Yields, wt. % based on MF Coal | | | |
| $H_2O$ | 6.8 | 6.0 | 5.8 |
| CO, $CO_2$, $H_2S$, $NH_3$ | 4.5[a] | 3.8[a] | 3.2 |
| $C_1$—$C_4$ | 17.6 | 17.2 | 16.6 |
| Naphtha ($C_5$-193° C.) | 11.4 | 9.4 | 7.3 |
| Middle Distillate (193–249° C.) | 7.8 | 7.9 | 6.8 |
| Heavy Distillate (>249° C.) | 25.5 | 23.6 | 23.4 |
| Total Oil ($C_5$-heavy distillate) | 44.7 | 40.9 | 37.5 |
| Solid dissolved coal (454° C. +) | 23.5 | 27.5 | 29.8 |
| Insoluble Organic Matter | 5.2 | 5.2 | 5.9 |
| Ash | 6.2[b] | 6.1[b] | 6.4 |
| Total | 108.5[c] | 106.8[c] | 105.2 |
| $H_2$ Reacted (gas balance) | 5.8 | 5.8 | 5.2 |
| MAF Conversion, % | 94.5 | 94.4 | 93.7 |

[a]Includes $H_2S$ derived from the added pyrite
[b]Corrected for ash derived from the added pyrite
[c]The total does not equal 100 + % $H_2$ due to the added pyrite
**Pyrite from coal washing, 85% pyrite, 15% rock. 100% through 150 mesh screen
*Data published in SOLVENT REFINED COAL (SRC) PROCESS, Monthly Report for the Period March, 1978, The Pittsburgh & Midway Coal Mining Co., Published April 1978, United States Department of Energy. Contract No. EX-76-C-01-496. FE/496-148 UC-90d. Page 13.

The data in Table 2 show that in a coal liquefaction process which employs recycle of a product slurry the injection of pyrite obtained from water washing of coal exerted a major effect upon the process. The data show that with 0.0, 0.9 and 2.2 weight percent of added pyrite the yields of the low value normally solid dissolved coal product were 29.8, 27.5 and 23.5 weight percent, respectively, and the yields of the total high value $C_5$+ distillate product were 37.5, 40.9 and 44.7 weight percent, respectively. Therefore, spiking with pyrite exerted a substantial advantageous effect in a coal solvent liquefaction process employing slurry recycle. In contrast, the data of Table 1 show that spiking with even larger amounts of pyrite had no significant effect in a process which did not employ slurry recycle.

The data of Tables 1 and 2 therefore show that the employment of a slurry recycle stream elevated added pyrite to catalytic effectiveness, whereas the pyrite was not catalytically effective when injected even in larger quantity in the absence of slurry recycle.

EXAMPLE 3

Data were taken to determine the particle size distribution, expressed as particle diameter in microns, of the pyrite and mill scale material injected into the coal liquefaction process in the tests of Examples 1 and 2. Data were also taken to show the specific gravity and size distribution of mineral particles (mineral residue particles comprise inorganic minerals plus undissolved organic matter) generated from feed coal in two typical coal liquefaction processes which did not employ slurry recycle. Finally, data were taken to show the particle size distribution and specific gravity of mineral residue particles generated from feed coal and contained in the effluent of a typical coal liquefaction process employing slurry recycle. The results of these tests are shown in Table 3.

TABLE 3

| Under indicated size - diameter in microns | Weight Percent of Particles Under Indicated Size: Mill Scale Additive (Pulverized) | Pyrite Additive (Pulverized) | Mineral residue generated from feed coal in processes without slurry recycle: A | B | Mineral residue generated from feed coal in processes with slurry Recycle |
|---|---|---|---|---|---|
| 0.5 (microns) | 0.5 (percent) | 7 (percent) | 1.5 (percent) | 2.5 (percent) | 7 (percent) |
| 1 | 1.5 | 11 | 7.5 | 8.5 | 15 |
| 2 | 7.5 | 16.5 | 25 | 26 | 36 |
| 3 | 15 | 22 | 43 | 40 | 56 |
| 4 | 23 | 26 | 55 | 50 | 70 |
| 5 | 31 | 29 | 63 | 56 | 80 |
| 8 | 52.5 | 38 | 72 | 64 | 93 |
| 10 | 65 | 42 | 73 | 67 | 96 |
| 20 | 94 | 58 | 77 | 72 | 99 |
| 30 | 99 | 70 | 79 | 77 | 100 |
| Average specific gravity of particles-g/cm$^3$ at 30° C. | 5.38 | 4.17 | 2.48 | 2.66 | 1.9 |
| Specific gravity of test liquid-g/cm$^3$ at 30° C. | 1.08 | 1.08 | 1.08 | 1.08 | 1.12 |

Table 3 shows that the particles of mill scale as fed into the coal liquefaction process in the tests of Tables 1 and 2 had a somewhat larger size and the added particles of pyrite had a moderately larger size than the typical sizes of mineral residue particles generated from feed coal in a coal liquefaction process without slurry recycle. Table 3 further shows that mineral residue particles generated from feed coal and contained in the effluent of a process employing slurry recycle are smaller than mineral residue particles generated from feed coal in processes which do not employ slurry recycle. Finally, Table 3 shows that the greatest difference between average particle specific gravity and the specific gravity of the test liquid (which is close to the specific gravity of the coal liquid normally associated with the particles) is exhibited in the case of the added mill scale and pyrite, a smaller difference between these specific gravities is exhibited in the case of the mineral residue generated from feed coal in a coal liquefaction process devoid of recycle slurry, and the smallest difference between these specific gravities is exhibited in a coal liquefaction process which does employ slurry recycle.

In the operation of a hydroclone to separate small from large particles, the maximum separation driving force occurs when removing small particles having a low specific gravity differential as compared to the associated liquid from large particles having a high specific gravity differential. The data of Table 3 indicate that a coal liquefaction process employing slurry recycle generates particles of smaller size and lower specific gravity differential than a similar process devoid of a slurry recycle step. The data of Table 3 thereby indicate that added iron compounds exhibited catalytic activity in the tests of Example 2 but not in the tests of Example 1 because the recycle operation reduced the size of the added solids. Apparently, the recycle operation encourages chemical reaction between inorganic minerals and hydrogen sulfide, hydrogen or other materials in the reaction environment, tending to change the size, density and composition of suspended potentially catalytic particles.

It is the discovery of the present invention that injected particles of potentially catalytic materials, such as iron sulfides, which are not catalytically effective or which are of minimal catalytic effectiveness, experience reduction in size and/or specific gravity or conversion to a more active chemical state under the influence of repeated recycle and become converted to a highly catalytic state. The catalytic activity of a solid catalyst increases with particle surface area, and external surface area increases as the particle diameter decreases. In a coal liquefaction process employing once-through operation, the particles of injected mill scale or pyrite are apparently at an as-fed size which is too large for catalytic effectiveness. Under the influence of repeated recycle in the tests of Table 2, the particles of injected pyrite are apparently reduced in size and density and converted to a chemical state in which they are as catalytically active or even more catalytically active as compared to mineral residue generated from the matrix of the feed coal.

The present invention utilizes a hydroclone to magnify the discovered effect of recycling upon size and specific gravity of recycled catalytic particles. The catalytic particles affected can be generated from the feed coal or can be injected. The hydroclone accomplishes the preferential recycle of relatively small particles, especially those having a relatively small particle gravity differential, to increase the concentration of these particles within the process.

It is the discovery of the effect exerted by the recycle stream upon injected or in situ-generated particles in a coal liquefaction process as demonstrated in Table 3 which makes possible the magnification of the advantage thereof. In accordance with the present invention, a hydroclone is operated in parallel with a primary slurry recycle stream and the hydroclone overflow stream is recycled in parallel with or in blend with the primary recycle stream. The hydroclone overflow stream selectively concentrates for recycle the relatively small, low density particles of additive or mineral residue, and selectively rejects larger, higher density particles from the coal liquefaction zone. The hydroclone overflow stream thereby selectively increases the proportion of the relatively small particles to the total solids in the total recycle slurry and in the liquefaction zone thereby reducing the median diameter of the particles in the recycle slurry.

Whether the catalytic solids comprise an added catalytic mineral or mineral residue generated from the feed coal, or both, the present process utilizes a discovered induced reduction in the median particle size of these solids and magnifies this effect to accomplish an improvement in the catalytic activity of the solids. The induced particle size reduction effect is magnified by the interdependent operation of a primary recycle slurry stream and a hydroclone overflow recycle slurry stream. These recycle streams flow in parallel and externally of the liquefaction zone. In order for these recycle streams to function interdependently to magnify the reduction in size of process solids, the process solids must be sufficiently small to be retained and transported within process slurries essentially without permanent accumulation of solids within the reactor. Permanent accumulation or storage of solids within the reactor (e.g. a fixed catalyst bed) would indicate the inefficient consumption of reactor space by relatively large particles whose inability to flow out of the reactor prevents their beneficiation in accordance with the present invention. Furthermore, relatively large particles remaining permanently within a reactor can tend to grow in size by deposit thereon of smaller circulating particles so that retention of solids within the reactor can have an effect upon particle size which is opposite to the particle size reducing effect of the present process.

The interdependent operation of a primary recycle slurry stream and a hydroclone overflow recycle slurry stream will reduce the median diameter of process solid particles, thereby providing an enhanced catalytic effect within the process at a given total solids recycle rate. The enhanced catalytic effect will tend to provide an increased yield of liquid coal at a given total solids recycle rate. The invention can also be embodied by allowing the reduced particle diameter to maintain a constant catalytic activity within the process by employing a reduced solids recycle rate. With a given solids constraint level in the feed coal mixing tank, the latter embodiment will allow an increase in the feed coal rate, thereby increasing plant capacity.

In order for the recycle of minerals to exert its full effect upon the liquefaction process it is necessary for the minerals to be recycled through both the preheater and dissolver zones of the liquefaction process. The coal liquefaction process begins in the preheater zone and is continued in the dissolver zone. Most feed coal dissolution occurs within the preheater zone. Free radicals are formed and capped with hydrogen in the preheater zone because of the depolymerization reactions occurring therein. Dissolved normally solid coal is hydrocracked to liquid coal and hydrocarbon gases in the dissolver zone. Because most of the dissolution of raw coal occurs in the preheater zone, most of the mineral residue particles are released from the coal matrix in the preheater zone while in the dissolver zone the mineral residue particles catalyze the hydrocracking of normally solid dissolved coal formed in the preheater zone to liquid coal and hydrocarbon gases.

EXAMPLE 4

Data presented blow show that the diameter in microns of mineral residue particles generated from the matrix of a feed coal within a coal liquefaction process is in part a characteristic of the feed coal, independent of the effect of a slurry recycle stream. The data of Table 4 show the size distribution of the particles of mineral residue generated during the solvent liquefaction of a Pittsburgh Seam coal and of a Kentucky coal, in independent processes which did not employ slurry recycle.

TABLE 4*

| Volume Percent of Particles Under Indicated Size | | |
|---|---|---|
| Under indicated size - diameter in microns | Kentucky coal-Volume Percent | Pittsburgh Seam Coal-Volume Percent |
| 2 (microns) | 9 | 5.5 |
| 3 | 40 | 12 |
| 4 | 71 | 18 |
| 5 | 88 | 25 |
| 6 | 93 | 30 |
| 10 | 98 | 51 |
| 15 | 99 | 70 |
| 20 | 99.3 | 82 |

*From graph published by Electric Power Research Institute in SRC QUARTERLY REPORT NO. 1, Analysis of Operations Runs 62 through 70, 1 January to 31 March 1976. Solvent Refined Coal Pilot Plant. Published 25 June 1976. Page 122

The data of Table 4 show that the volume percent of particles having a diameter below 5 microns is about $3\frac{1}{2}$ times higher for the Kentucky coal as compared to the Pittsburgh Seam coal. It is generally known that the product of solvent liquefaction of a Kentucky coal has a higher relative yield of liquid coal to normally solid dissolved coal, as compared to the product of solvent liquefaction of a Pittsburgh Seam coal.

In an independent inventive embodiment a hydroclone is employed to isolate and magnify a catalytic effect from the smaller particles generated from a particular one of a plurality of feed coals. The smaller particles of mineral residue generated from one of the feed coals will tend to be concentrated in the hydroclone overflow stream, while the larger particles generated by the other feed coal will tend to be concentrated in the hydroclone underflow stream. The consequent build-up of relatively small catalytically active particles in the recycle stream can permit the total weight of mineral residue which is recycled to be moderated with a beneficial effect upon process yields. In this inventive embodiment, a plurality of coal feeds are charged to a process, wherein the median diameter of the mineral residue particles generated from the matrix of one of the feed coals is considerably smaller than the median diameter of the mineral residue particles generated from the matrix of the other feed coal. The hydroclone will tend to increase the proportion of small mineral residue particles in the recycle stream so that the concentration in the process of recycle mineral residue particles derived from one of the feed coals will be increased. In this inventive embodiment, the coal from which the small particles is derived will comprise at least 5 or 10, and possibly at least 20, 30 or 50 weight percent, on a dry basis, of the total feed coal to the process. The remainder of the total feed coal comprises one or more feed coals generating mineral residue particles having a larger or a different median size.

In still another independent inventive embodiment, an extraneous catalytic solid or solids is added to a coal solvent liquefaction process with an as-fed median particle diameter which is smaller than the median diameter of the particles generated in situ from the matrix of the feed coal in once-through operation without the aid of slurry recycle. Pyrite obtained from water washing of the feed coal of the process or obtained from the water washing of coal from a different mine constitutes a suitable extraneous catalytic solid. Coals are frequently water washed to lower the sulfur content thereof since a coal loses sulfur by pyrite extraction during water washing. Although iron-containing materials tend to be catalytically active, other catalytically active additives containing Group VI and Group VIII metals can be employed. The as-fed median diameter of such extraneous particles is advantageously less than 3 microns, and is preferably less than 1 or 2 microns. A particularly advantageous as-fed median particle size range is below 2 microns, and can be between about 0.1 and 1 micron. The relatively small size of the extraneous particles will permit them to be isolated in the hydroclone overflow stream in a greater weight proportion than the aliquot weight proportion of these particles as-fed to the mineral residue generated from the feed coal. Thereby, there is a cooperative effect between the relatively small particle size of the extraneous catalytic solids and the development of the hydroclone.

The particle size of the extraneous solids can be regulated prior to introduction to the process by mechanical means, such as pulverization or grinding, or by chemical means, such ad dissolution and precipitation.

Extraneous solids can be selected so that during repeated recycle under process conditions the solids disintegratively react to form particles whose median diameter is as small as or smaller than the median diameter of the particles generated upon recycle of mineral residue derived from the feed coal. The as-fed median particle diameter of extraneous solids of this type can be larger than the median diameter of recycle particles generated from the feed coal, although the as-fed median diameter can also be smaller than or the same as the median diameter of the recycle particles generated from the feed coal. Many reactions can occur within the process to disintegrate extraneous solids upon repeated recycle. For example, extraneous pyrite may experience disintegration upon repeated recycle via the reducing reaction $FeS_2 \xrightarrow{H_2} FeS + H_2S$. Other disintegrative reactions involving pyrite or other additives can occur. For example, iron oxides upon repeated recycle may experience disintegrative sulfiding reactions to form ferric sulfide, which can be followed by disintegrative reducing reactions to produce ferrous sulfide.

EXAMPLE 5

The data of Table 2 show that in a coal liquefaction process employing slurry recycle injection of pyrite in variable amounts, or, what is equivalent, recycle in varying rates of a hydroclone overflow stream containing small particles of process mineral residue, induces a reduction in the amount of normally solid dissolved coal in the feed mix vessel. Since the normally solid dissolved coal in the feed mix vessel is derived directly from the recycle slurry and since the non-recycled portion of this recycle slurry constitutes the hydrocarbonaceous feed for a gasification zone integrated with the liquefaction zone in the manner described above, the reduced concentration of normally solid dissolved coal in the feed mix vessel is reflected by a reduced normally solid dissolved coal feed for the gasifier. Such a reduced gasifier feed load is highly advantageous because, as stated above, a high thermal efficiency in an integrated coal liquefaction-gasifiction process requires lower yields of normally solid dissolved coal that are sometimes achievable in a coal liquefaction process operating under a slurry pumpability constraint.

The data of Table 2 therefore indicate that the present invention can be applied with high advantage to an integrated coal liquefaction-gasification process wherein some of the normally solid dissolved coal slurry is recycled and the remainder constitutes a gasifier feed slurry. Under prior art methods, the recycled slurry and the gasifier feed slurry contain an aliquot size distribution of particles. However, in accordance with the present process, the suspended particles in the normally solid dissolved coal slurry are at least in part segregated by particle size, with the recycled slurry portion being relatively richer in smaller particles and the gasifier feed slurry portion being relatively richer in larger particles, as compared to the particle size distribution in the undivided product slurry. The segregation by size of slurry particles imparts a novel degree of freedom in the control of an integrated liquefaction-gasification process which permits reduction of the yield of normally solid dissolved coal in a process subject to a solids level pumpability constraint.

Figure 2:
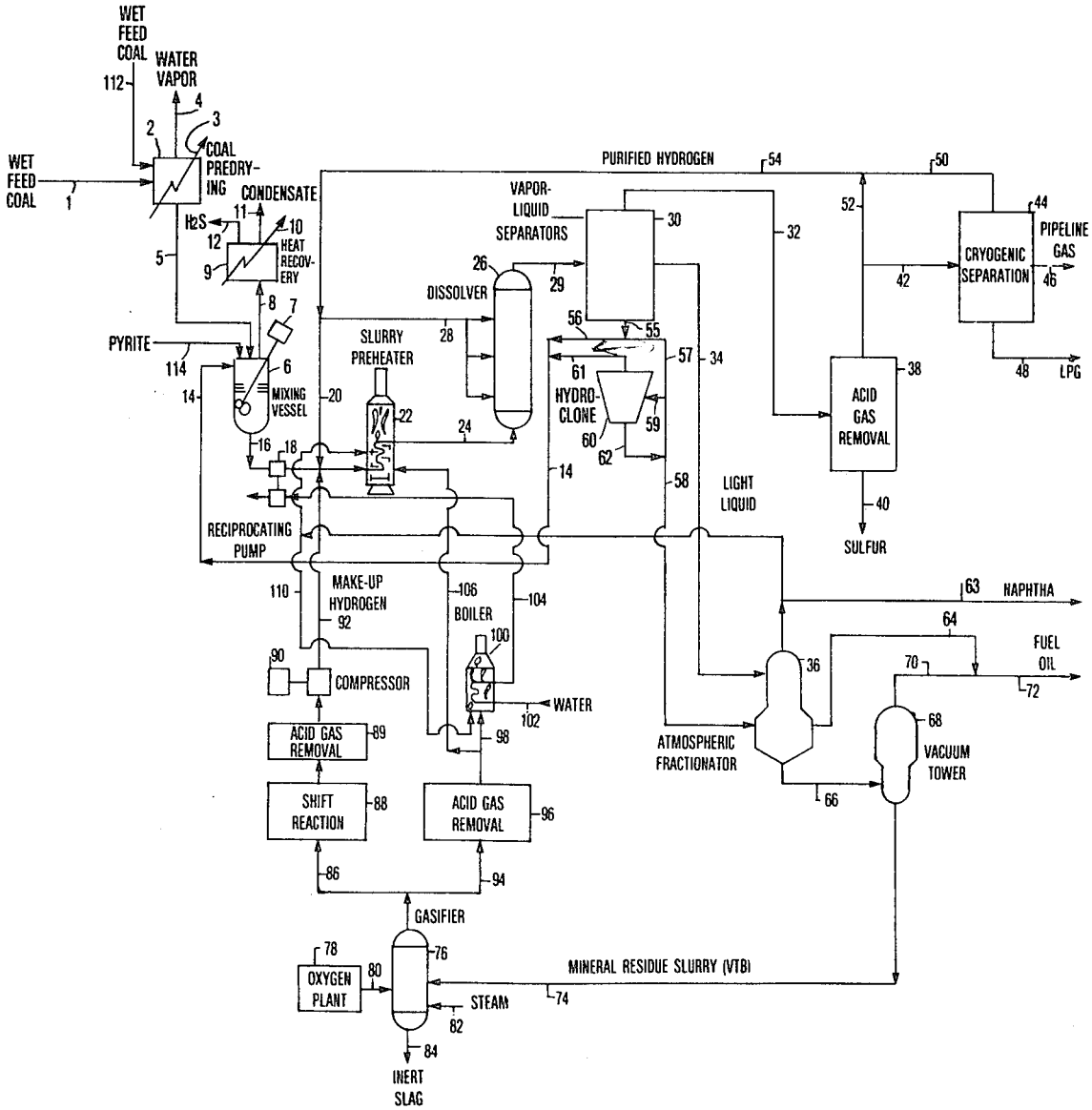

FIG. 2 contains a diagram of an integrated coal liquefaction-gasification process embodying the features described herein. As shown in FIG. 2, pulverized wet raw coal is passed through line 1 to coal predrying zone 2. If desired, a wet raw coal which generates relatively small particles of mineral residue upon dissolution can also be added through line 112. Heat is added to predrying zone 2 through line 3 and water vapor obtained by drying the coal is removed through line 4. Partially dried feed coal is passed through line 5 to mixing vessel 6 which is agitated by means of stirrer 7. If desired, a catalytic additive, such as pyrite, whose particles have or undergo transition to a smaller median diameter than mineral residue generated by either or both feed coals can be introduced to vessel 6 through line 114. Mixing vessel 6 is maintained under a pressure of about 3 inches (7.6 cm) of water. The temperature in the mixing vessel is between about 300° and 500° F. (150° and 260° C.). Heat is added to mixing vessel 6 by means of hot solvent-containing recycle slurry entering through line 14. The recycle slurry in line 14 is essentially free of hydrocarbons boiling below the temperature in mixing vessel 6. Essentially complete drying of the feed coal is accomplished in vessel 6. Water vapor formed by drying the feed coal together with other gases is vented through line 8 to heat recovery zone 9. Heat is recovered in zone 9 by means of a cooling fluid, such as boiler feed water, passing through line 10. Condensate is recovered from zone 9 through line 11 while hydrogen sulfide and any entrained hydrocarbon gases are recovered through line 12.

About 1.5 to 4 parts by weight of recycle slurry per part of dry feed coal enters mixing vessel 6 through line 14. Mixing vessel effluent slurry in line 16 is essentially water-free and is under a solids level constraint. The slurry in line 16 is pumped by means of reciprocating pump 18 and admixed with recycle hydrogen entering through line 20 and will make-up hydrogen entering through line 92 prior to passage through tubular preheater furnace 22 from which it is discharged through line 24 to dissolver zone 26.

The temperature of the reactants in preheater outlet line 24 is about 700° to 760° F. (371° to 404° C.). At this temperature the coal is partially dissolved in the recycle solvent, particles of mineral residue are released from the coal matrix and exothermic hydrogenation and hydrocracking reactions are just beginning. Whereas the temperature of the slurry gradually increases along the length of the tubing in preheater 22, the slurry within the dissolver zone 26 is at a generally uniform temperature throughout. The heat generated by the hydrogenation and hydrocracking reactions in dissolver zone 26 raises the temperature of the reactants to the range 840°–870° F. (339°–466° C.). Hydrogen quench passing through line 28 is injected into dissolver zone 26 at a plurality of positions to control the reaction temperature and alleviate the impact of the exothermic reactions. The ratio of total hydrogen to dry feed coal is about 40,000 SCF/ton (1.24 $M^3$/kg).

Dissolver zone effluent passes through line 29 to vapor-liquid separator system 30. The hot overhead vapor stream from these separators is cooled in a series of heat exchangers and additional vapor-liquid separation steps, not shown, and removed through line 32. The liquid distillate from vapor-liquid separator 30 passes through line 34 to atmospheric fractionator 36. The non-condensed gas in line 32 comprises unreacted hydrogen, methane and other light hydrocarbons, plus $H_2S$ and $CO_2$. The hydrogen sulfide recovered is converted to elemental sulfur which is removed from the process through line 40. A portion of the purified gas is passed through line 42 for further processing in cryogenic separator 44 for removal of much of the methane and ethane as pipeline gas which passes through line 46 and for the removal of propane and butane as LPG which passes through line 48. Purified hydrogen (90 percent pure) in line 50 is blended with the remaining gas from the acid gas treating step in line 52 and comprises the recycle hydrogen for the process.

The residue slurry from vapor-liquid separators 30 passes through line 55 and is divided into streams 56 and 57. Stream 56 comprises the primary recycle slurry and contains solvent, normally solid dissolved coal and catalytic mineral residue. Stream 56 contains between about 5 and 40 weight percent of mineral residue. The particles of mineral residue in stream 56 have a median diameter between about 1 and 10 microns. There are between about 0.2 and 4 weight parts of stream 56 per weight part of dry feed coal. Of the non-recycled slurry passing through line 57, a portion is passed through line 58 to atmospheric fractionator 36 for separation of the major products of the process. Another portion of the non-recycled slurry is passed through line 59 and enters hydroclone 60 tangentially wherein it is separated into a solids-lean overflow stream passing through line 61 and a solids-rich underflow stream passing through line 62. The solids-lean overflow stream contains between about 0.2 and 10 weight percent of mineral residue having a median diameter between about 0.5 and 5 microns. There are between about 0.2 and 4 weight parts of stream 61 per weight part of dry feed coal. The streams in lines 56 and 61 are either combined in line 14 for recycle to feed mixing vessel 6, as shown, or can be independently recycled to mixing vessel 6. The streams in lines 56 and 61 are at a temperature above the temperature in mixing vessel 6 so that they heat and remove essentially all the water in the coal in mixing vessel 6.

The streams in lines 57 and 62 are combined in line 58 for passage to atmospheric fractionator 36. The slurry in fractionator 36 is distilled at atmospheric pressure to remove an overhead naphtha stream through line 63, a middle distillate stream through line 64 and a bottoms stream through line 66. The bottoms stream in line 66 passes to vacuum distillation tower 68. A blend of fuel oil recovered from the atmospheric tower line 64 and middle distillate recovered from the vacuum tower in line 70 makes up the major fuel oil product of the process and is recovered through line 72.

The bottoms from the vacuum tower, consisting of all the normally solid dissolved coal, undissolved organic matter and inorganic mineral matter, essentially without any 380°-850° F. (193°-454° C.) distillate liquid (or hydrocarbon gases), is passed through line 74 directly to partial oxidation gasifier zone 76. Nitrogen-free oxygen for gasifier 76 is prepared in oxygen plant 78 and passed to the gasifier through line 80. Steam is supplied to the gasifier through line 82. The mineral content of the feed coals supplied through lines 1 and 112 and the pyrite supplied through line 114 is eliminated from the process as inert slag through line 84, which discharges from the bottom of gasifier 76. Synthesis gas is produced in gasifier 76 and a portion thereof passes through line 86 to shift reactor zone 88 for conversion by the shift reaction wherein steam and CO are converted to $H_2$ and $CO_2$, followed by an acid gas removal zone 89 for removal of $H_2S$ and $CO_2$. Purified hydrogen (90 to 100 percent pure) is then compressed to process pressure by means of compressor 90 and fed through line 92 as make-up hydrogen for preheater zone 22 and dissolver zone 26.

Process efficiency is improved if the amount of synthesis gas produced in gasifier 76 is sufficient not only to supply all the molecular hydrogen required by the process but also to supply, without a methanation or other conversion step, between 5 and 100 percent of the total heat and energy requirement of the process. To this end, the portion of the synthesis gas that does not flow to the shift reactor passes through line 94 to acid gas removal unit 96 wherein $CO_2+H_2S$ are removed therefrom. The removal of $H_2S$ allows the synthesis gas to meet the environmental standards required of a fuel while the removal of $CO_2$ increases the heat content of the synthesis gas so that a higher heat of combustion can be achieved. A stream of purified synthesis gas passes through line 98 to boiler 100. Boiler 100 is provided with means for combustion of the synthesis gas as a fuel. Water flows through line 102 to boiler 100 wherein it is converted to steam which flows through line 104 to supply process energy, such as to drive reciprocating pump 18. A separate stream of synthesis gas from acid gas removal unit 96 is passed through line 106 to preheater 22 for use as a fuel therein. The synthesis gas can be similarly used at any other point of the process requiring fuel. If the synthesis gas does not supply all of the fuel required for the process, the remainder of the fuel and the energy required in the process can be supplied from any non-premium fuel stream prepared directly within the liquefaction zone. If it is more economic, some or all of the energy for the process, which is not derived from synthesis gas, can be derived from a source outside of the process, not shown, such as from electric power.

We claim:

1. An integrated coal liquefaction-gasification process wherein the net production of normally solid dissolved coal containing mineral residue from the liquefaction zone comprises the hydrocarbonaceous feed for the gasification zone; said process comprising passing mineral-containing feed coal, hydrogen, recycle dissolved liquid solvent, recycle normally solid dissolved coal and recycle mineral residue to a coal liquefaction zone which does not contain a fixed bed of added catalyst to dissolve hydrocarbonaceous material and to produce a mixture comprising hydrocarbon gases, dissolved liquid, normally solid dissolved coal and suspended mineral residue; passing a liquefaction zone effluent stream through a vapor-liquid separator means to remove overhead hydrogen, hydrocarbon gases and naphtha from a residue slurry comprising liquid coal and normally solid dissolved coal with suspended mineral residue; recycling to said liquefaction zone a first portion of said residue slurry; passing a second portion of said residue slurry to product separation means including vacuum distillation means; passing a third portion of said residue slurry through hydroclone means; recovering from said hydroclone means an overhead slurry comprising liquid coal and normally solid dissolved coal containing particles of suspended mineral residue having a smaller median diameter as compared to the median diameter of the particles in said first portion of residue slurry; recycling said overflow slurry to said liquefaction zone to reduce the median diameter of the particles recycled to said liquefaction zone; recovering from said hydroclone means an underflow slurry comprising liquid coal and normally solid dissolved coal containing particles of suspended mineral residue having a larger median diameter than the median diameter of the particles in said first portion of residue slurry; passing said underflow slurry to said product separation means; separating liquid coal in said vacuum distillation means in said product separation means from a gasifier slurry comprising normally solid dissolved coal and mineral residue; passing said gasifier slurry to the gasification zone for conversion to hydrogen; and passing said hydrogen to the coal liquefaction zone.

2. The process of claim 1 wherein said gasification zone also produces synthesis gas for use as fuel in said integrated process.

3. The process of claim 1 wherein the median diameter of particles of suspended mineral residue in said first portion of residue slurry is between about 1 and 10 microns and the median diameter of particles of suspended mineral residue in said overflow slurry is smaller and is between 0.5 and 5 microns.

4. The process of claim 1 wherein said overflow slurry contains less than an aliquot weight proportion of solids and said underflow slurry contains more than an aliquot weight proportion of solids as compared to the weight proportion of solids in said third portion of residue slurry.

5. The process of claim 1 wherein said third portion of residue slurry comprises between about 10 and 75 weight percent of the total residue slurry.

6. The process of claim 1 wherein said residue slurry contains between about 5 and 40 weight percent solids.

7. The process of claim 1 wherein said overflow slurry contains between about 0.2 and 20 weight percent solids.

8. The process of claim 1 wherein said feed coal contains at least about 15 weight percent of inorganic mineral matter on a dry basis.

9. The process of claim 1 wherein said feed coal contains at least about 20 weight percent of inorganic mineral matter on a dry basis.

* * * * *